US005462266A

United States Patent [19]

Meier

[11] Patent Number: 5,462,266

[45] Date of Patent: Oct. 31, 1995

[54] PROCESS AND APPARATUS FOR OPENING FOLDED PRINTED PRODUCTS

[75] Inventor: Jacques Meier, Bäretswil, Switzerland

[73] Assignee: Ferag AG, Switzerland

[21] Appl. No.: 160,386

[22] Filed: Dec. 1, 1993

[30] Foreign Application Priority Data

Dec. 4, 1992 [CH] Switzerland ..... 03724/92

[51] Int. Cl.[6] ..... B65H 39/02; B65H 29/04

[52] U.S. Cl. ..... 270/54; 271/204

[58] Field of Search ..... 270/54, 55; 271/175, 271/200, 204, 277

[56] References Cited

U.S. PATENT DOCUMENTS

| | | | |
|---|---|---|---|
| 2,817,513 | 12/1957 | Bell et al. . | |
| 3,527,455 | 9/1970 | Reist . | |
| 3,580,562 | 5/1971 | Reist . | |
| 3,601,388 | 8/1971 | Hilliard . | |
| 3,623,386 | 11/1971 | Bach et al. . | |
| 3,650,524 | 3/1972 | Hepp . | |
| 3,722,877 | 3/1973 | Wetter . | |
| 4,201,286 | 5/1980 | Meier . | |
| 4,333,559 | 6/1982 | Reist . | |
| 4,381,056 | 4/1983 | Eberle . | |
| 4,398,710 | 8/1983 | Hänsch . | |
| 4,489,930 | 12/1984 | Meier | 270/55 |
| 4,555,101 | 11/1985 | Stobb | 270/58 |
| 4,605,213 | 8/1986 | Hechler . | |
| 4,678,174 | 7/1987 | Reist | 270/54 |
| 4,684,116 | 8/1987 | Hänsch | 270/54 |
| 4,684,117 | 8/1987 | Honegger et al. | 270/54 |
| 4,709,910 | 12/1987 | Honegger . | |
| 4,729,554 | 3/1988 | Honegger . | |
| 4,775,137 | 10/1988 | Glanzmann . | |
| 4,893,805 | 1/1990 | Eberle . | |
| 5,042,667 | 10/1991 | Hänsch | 270/55 |
| 5,137,409 | 8/1992 | Honegger | 270/55 X |
| 5,169,139 | 12/1992 | Stauber et al. | 271/204 |
| 5,188,349 | 2/1993 | Honegger . | |
| 5,248,135 | 9/1993 | Leu | 270/55 |
| 5,292,111 | 3/1994 | Hansch | 270/54 |
| 5,354,043 | 10/1994 | Reist | 270/54 |

FOREIGN PATENT DOCUMENTS

| | | |
|---|---|---|
| 0169490A1 | 1/1986 | European Pat. Off. . |
| 0208081A1 | 1/1987 | European Pat. Off. . |
| 0379879 | 1/1990 | European Pat. Off. . |
| 1024530 | 2/1958 | Germany . |
| 1945501 | 3/1970 | Germany . |
| 618398 | 7/1980 | Switzerland . |
| 667859A5 | 11/1988 | Switzerland . |
| 1095733 | 12/1967 | United Kingdom . |

*Primary Examiner*—Edward K. Look
*Assistant Examiner*—John E. Ryznic
*Attorney, Agent, or Firm*—Willian Brinks Hofer Gilson & Lione

[57] ABSTRACT

Folded printed products are transported while held in suspended position at their fold and supported in their end region remote from the fold. The end section of the first product part, projecting with respect to the second product part, is seized and temporarily held by a gripper which is driven in a circulating manner. A stabbing element, driven at a different speed with respect to the gripper, then stabs into the printed product and lifts the second product part off the held first product part while the gripper moves away from the stabbing element. With the printed product open, the gripper releases the first product part.

26 Claims, 7 Drawing Sheets

PROCESS AND APPARATUS FOR OPENING FOLDED PRINTED PRODUCTS

BACKGROUND OF THE INVENTION

The present invention relates to a process and an apparatus for opening folded printed products, and more particularly the present invention relates to a process and an apparatus for opening folded printed products which uses a stabbing element in conjunction with a gripper device to open printed products.

U.S. Pat. No. 4,489,930 and the corresponding EP A-0 095 603 teach an arrangement wherein folded printed products, which are folded in an off-centered manner, are held by transport clips such that the fold runs transversely to the conveying direction and conveyed hanging obliquely to the rear. Underneath this conveying device there is an opening unit having an endless belt which is driven at the conveying speed of the conveying device. Grippers are arranged on the conveying belt such that they have the same spacing as the transport clips. The active side of the belt runs parallel to the conveying direction. The belt is preceded by a supporting member, in order to support the printed products in their trailing end region, opposite the fold. Following on from the belt (seen in the conveying direction) is a small acceleration belt. The small acceleration belt circulates at a higher speed than the conveying speed of the conveying device and the belt. In this off-center arrangement, the printed products have an upper-lying first product part which projects beyond a shorter, lower-lying second product part. This border section of each printed product is seized by a gripper of the opening unit and firmly clamped between itself and the belt. The lower-lying second product part is then moved away from the faster-running acceleration belt. This results in a bulging of the held first product part, and the printed product is thus opened. A saddle-shaped rest of a processing device then runs into each of the opened printed products between the product parts, which have been lifted off of each other. After release of the printed products by the transport clips, the products fall astride onto the rests. With this known process and with this known apparatus it is only possible to open off-centered folded printed products which are transported with a trailing end region and an upper-lying border section. Reliable opening of the printed products is only possible if the paper has a low intrinsic rigidity and the lower-lying product part has a certain weight. Moreover, in order to reliably open the printed products, the product parts cannot adhere to each other, for example due to electrostatic charging.

It is therefore an object of the present invention to develop the generic process and to provide a corresponding apparatus such that opening is independent of the position and the nature of the printed products and is reliably ensured.

SUMMARY OF THE INVENTION

According to the invention, a stabbing element is used with a gripper device to open printed products. The stabbing element is used to stab into the printed product between a held first product part and second product part. As a result, the second product part is forcibly lifted off the first product part. The stabbing element and gripper are moved away from each other. As a result, the printed product is forcibly opened. The gripper holding the first product part at the end edge precisely defines the position of the first product part in the end region, thereby making exact stabbing possible. Due to the forcible separating of the two product parts with the stabbing element, the processing of the printed products can be performed at high speed.

BRIEF DESCRIPTION OF THE DRAWING

The present invention is now described in more detail with reference to the drawing, in which purely schematically.

DETAILED DESCRIPTION OF THE INVENTION

Figure 1:
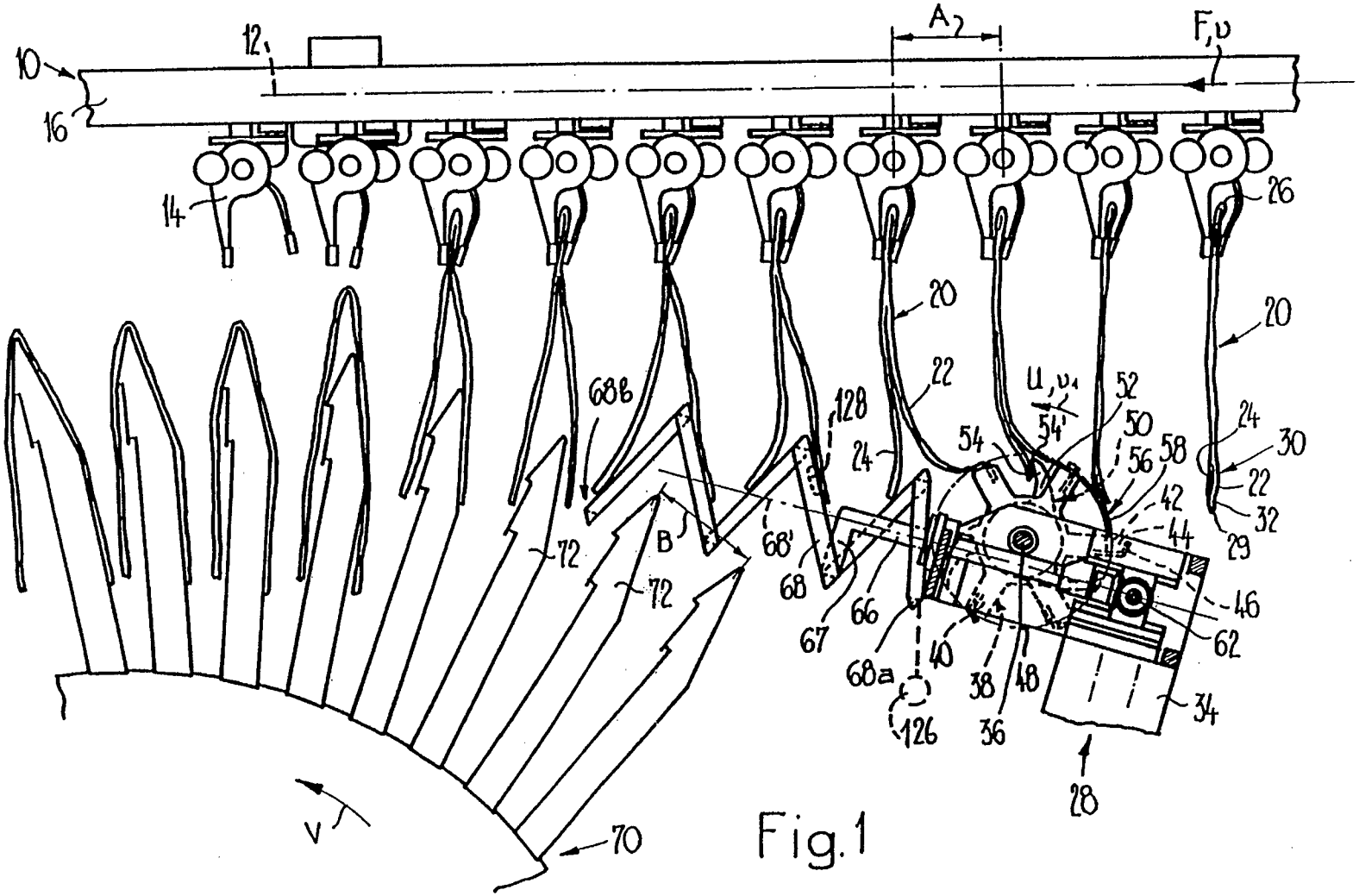
FIGS. 1 and 2 show (respectively in elevation and plan view and partially in section) a first embodiment of the apparatus according to the invention for opening off-center folded printed products with a trailing first product part, the border section of which projects beyond the second product part.

Referring now to the figures, the apparatus according to the invention has a conveying device 10 of a conventionally known type with individually control-lable transport clips 14. The transport clips 14 are arranged at a fixed spacing A, one behind the other, on a conveying chain 12 indicated by dot-dashed lines. The conveying chain 12 is guided in a C-shaped, downwardly open and horizontally extending channel 16. The transport clips 14, driven in a continuously running manner in conveying direction F at a conveying speed v, have a vertically downwardly directed clip mouth 18. A folded printed product 20 is held in each of the clip mouths 18. The printed products may be, for example, a multi-sheeted newspaper, periodical or part thereof. The printed products are held with the fold 26 running at right angles to the conveying direction F and with the first product part 22 and second product part 24 joined to each other. (See FIGS. 1 and 2.)

Arranged underneath the conveying device 10 is an opening unit 28. The opening unit 28 is designed for the purpose of opening off-center folded printed products 20 with the first product part 22 trailing with respect to the second product part 24, the first product part 22 having at its end edge 29, in the end region 30 facing away from the fold 26, an end section 32 which projects beyond the second product part 24.

Mounted on a frame 34 of the opening unit 28 is a shaft 36. The shaft 36 is driven at right angles to the conveying direction F and in a horizontally running manner. A carrying member 38, which is designed like a star wheel, is seated on the shaft 36 in a rotationally fixed manner in the vertical direction underneath the conveying device 10. The radially outer ends of the carrying arms 40 of the carrying member 38 are designed as fixed gripper jaws 42 of grippers 44. Gripper tongues 46, which can be moved approximately in a radial direction away from the gripper jaws 42 into an open position and in the opposite direction into a closed position, interact with the gripper jaws 42. The grippers 44 run on a circular circulating path 48 at a circulating speed v1. The circulating speed v1 corresponds approximately to the conveying speed v or, if appropriate, may be up to about 30% greater. The gripper tongues 46 are movable into the open position or closed position, for example by means of a link or cam motion, depending on their rotational position.

Mounted in freely rotatably manner on the shaft 36 alongside the carrying member 38 is a stabbing wheel 50. The stabbing wheel 50 is also designed like a star. The radially outwardly protruding arms 52 of the stabbing wheel 50 are bent forward (seen in the circulating direction U) and are designed in their end region as a stabbing element 54. The stabbing edges 54' of the stabbing elements 54 run on a path which is offset in the axial direction with respect to the circulating path 48 of the gripper jaws 42 of the grippers 44 and is of the same diameter. The stabbing wheel 50 has three stabbing elements 54 and is driven at twice the rotational speed of the carrying member 38, which carries six grippers 44.

Underneath the conveying device 10 there is further provided a supporting element 56. In the present embodiment, the supporting element 56 is formed by two bent supporting plates 58. The supporting plates 58 are fastened on the frame 34 on both sides of the carrying member 38 and at a distance from the latter and from the stabbing wheel 50. The supporting plates 58 have the same curvature as the circulating path 48 of the grippers 44 and are arranged in line with the latter in the axial direction. The supporting plates 58 in this embodiment extend approximately from the height of the shaft 36 over an angle of about 80° upward on the side of the opening unit 28 facing the incoming printed products 20. The vertical distance between the opening unit 28 and the conveying device 10 is set such that the printed products 20, which are transported in a vertical suspended position, run with their end region 30 onto the supporting plates 58. Here the printed products 20 come to bear against the supporting plates 58, the end regions 30 being bent rearward (seen in conveying direction F) and thereby undergo a delay.

The shaft 36 and the stabbing wheel 50 are connected by means of chain drives 60, 60' to an input shaft 62. The input shaft 62 is connected, in a rotationally fixed manner, by means of bevel gear mechanisms 64 to two output shafts 66. The output shafts 66 run parallel to each other and are laterally offset approximately symmetrically with respect to the carrying member 38. Carrying arms 67 protrude at the ends of the output shafts 66, remote from the bevel gear mechanisms 64. On each of these carrying arms 67 there is fastened a spiral-like or screw-like holding-open elements 68. The longitudinal axes 68' of these holding-open elements 68 are in line with the axes of the output shafts 66, which are mounted on the frame 34. These longitudinal axis 68' are also arranged in vertical planes which run parallel to the conveying direction F. Seen in conveying direction F, the longitudinal axes 68' are arranged so that they rise slightly. The ends of the holding-open elements 68, which face the carrying member 38, are arranged following the carrying member 38 (seen in conveying direction F). These ends circulate in a plane which approximately forms a tangent to the circulating path 38 of the grippers 44. The pitch of the turns of the holding-open elements 68 is adapted to the respective conditions and preferably increases from the rear end 68*a* toward the front end 68*b*.

The carrying arms 67 may be fastened displaceably on the input shafts 66 for adjusting the position of the holding-open elements 68 with respect to the input shafts 66. This makes it possible to displace the holding-open elements 68 in the direction of their longitudinal axis 68' and consequently to adapt them to the respective conditions.

Seen in conveying direction F, a processing drum is provided following the opening unit 28 and likewise underneath the conveying device 10. This drum 70 is driven in circulating direction V and is known, for example, from U.S. Pat. No. 5,052,667 and the corresponding EP A 0 341 425 which are incorporated herein by reference. The drum 70 has saddle-shaped rests 72, running in the axial direction and consequently approximately at right angles to the conveying direction F. The rests 72 receive astride the printed products 20 which have been opened by means of the opening unit 28 and which are held open by means of the holding-open elements 68. The spacing B of the rests 72 in this case corresponds substantially to the spacing A of the transport clips 14. Preferably the spacing B also corresponds to the pitch of a turn of the holding-open elements 68 at the front end 68*b* of the latter.

The apparatus shown in FIGS. 1 and 2 operates as follows: the printed products 20, transported in vertical suspended position, run with their end region 30 onto the supporting plates 58 and are thereby supported in the end region 30, with bending counter to the transporting direction F. At the same time, with conveying speed v remaining the same, the speed of the end edge 29 of the respective printed product 20 is reduced. At the same time, an opened gripper 44 fetches the printed product 20, which bears against the supporting plates 58. During the transfer of the gripper tongue 46 into the closed position, before reaching the end of the supporting plates 58, the printed product 30 is seized and firmly held at the end section 32. Due to the rearward bending of the printed product 20, a greater region of the end section 32 is exposed. This further increases the certainty that the second product part is not seized by the gripper 44, since the depth of the gripper mouth is designed to be correspondingly small. A stabbing element 54 then stabs from underneath the held end section 32 between the first product part 22 and second product part 24 and forcibly lifts or peels the second product part 24 off the held first product part 22. This results because the stabbing element 54 moves with approximately twice the circulating speed v1 relative to the gripper 44 and consequently distances itself from the gripper 44 (seen in circulating direction U). The end, facing the carrying member 38 of the two holding-open elements 68, then engages from below between the two product parts 22, 24, lifted off each other, after which the gripper 44 is opened. Due to the synchronization of the opening unit 28 with the conveying device 10, the part of the opening elements 68 respectively engaging in the printed product 20 then runs with it in conveying direction F, holds the printed product 20 open and opens it still further, since the holding-open elements 68 come closer to the conveying direction F on account of the oblique position. A rest 72 engages from below in each case between a turn of the holding-open elements 68 and moves in conveying direction F, likewise synchronized with the conveying device 10. This results in each of the respective rests 72 coming to lie from below between the product parts 22, 24 which have been lifted off each other, before the holding-open elements 68 release the product parts 22, 24. The printed product 20 extending from above over a rest 72 is then released by opening of the respective transport clip 14 and falls astride onto the respective rest 72 for further processing.

Figure 2:
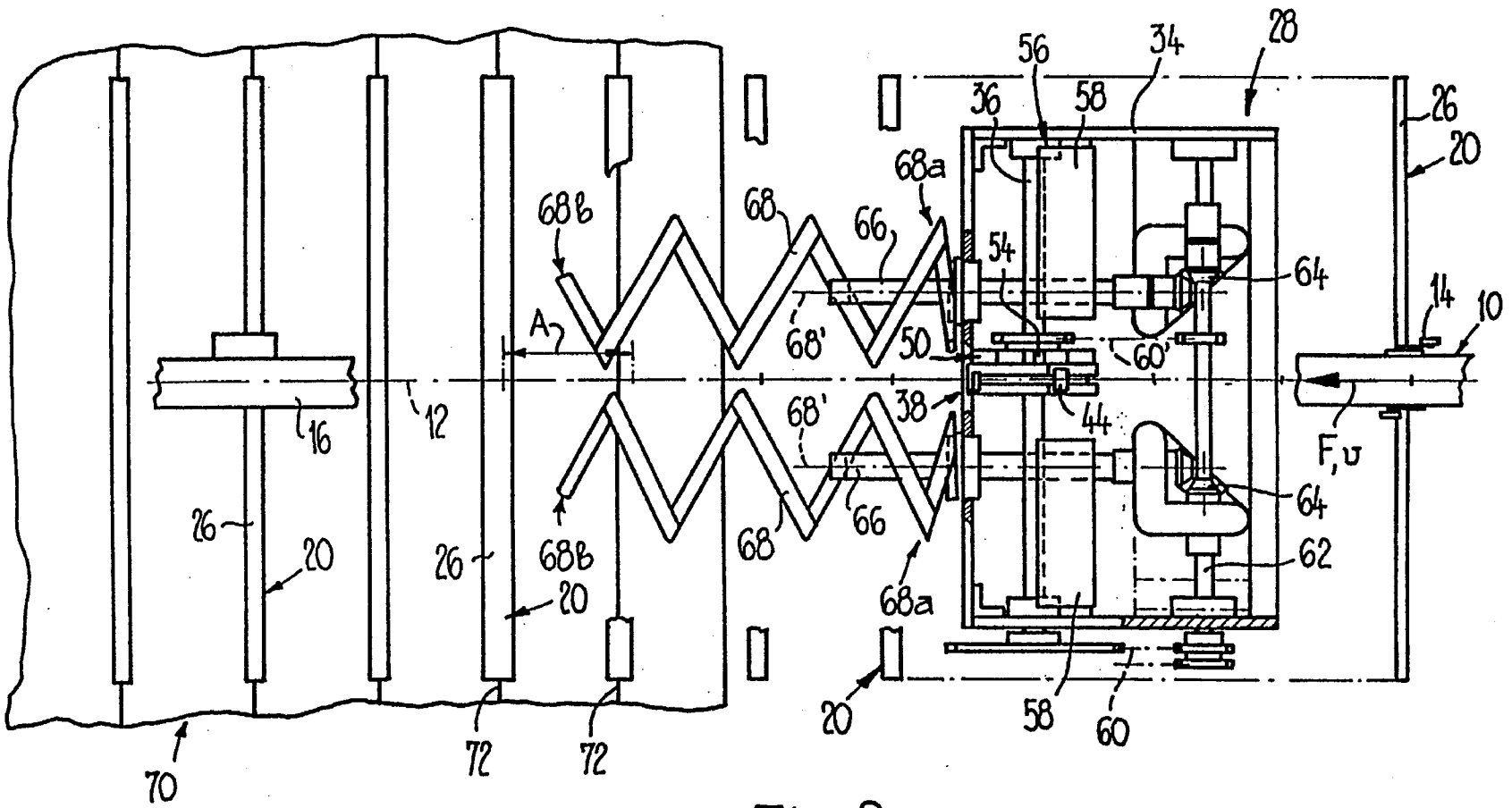

The basic construction of the apparatus as shown in FIGS. 1 and 2 and described above does not differ from the embodiments shown in the other figures. Only the design of the carrying member 38, of the grippers 44, and suspension of the stabbing elements 54 and of the supporting elements 56 is partly different.

Therefore, primarily only these different parts are described below. Otherwise, reference is made expressly to the above description and to FIGS. 1 and 2.

Figure 3:
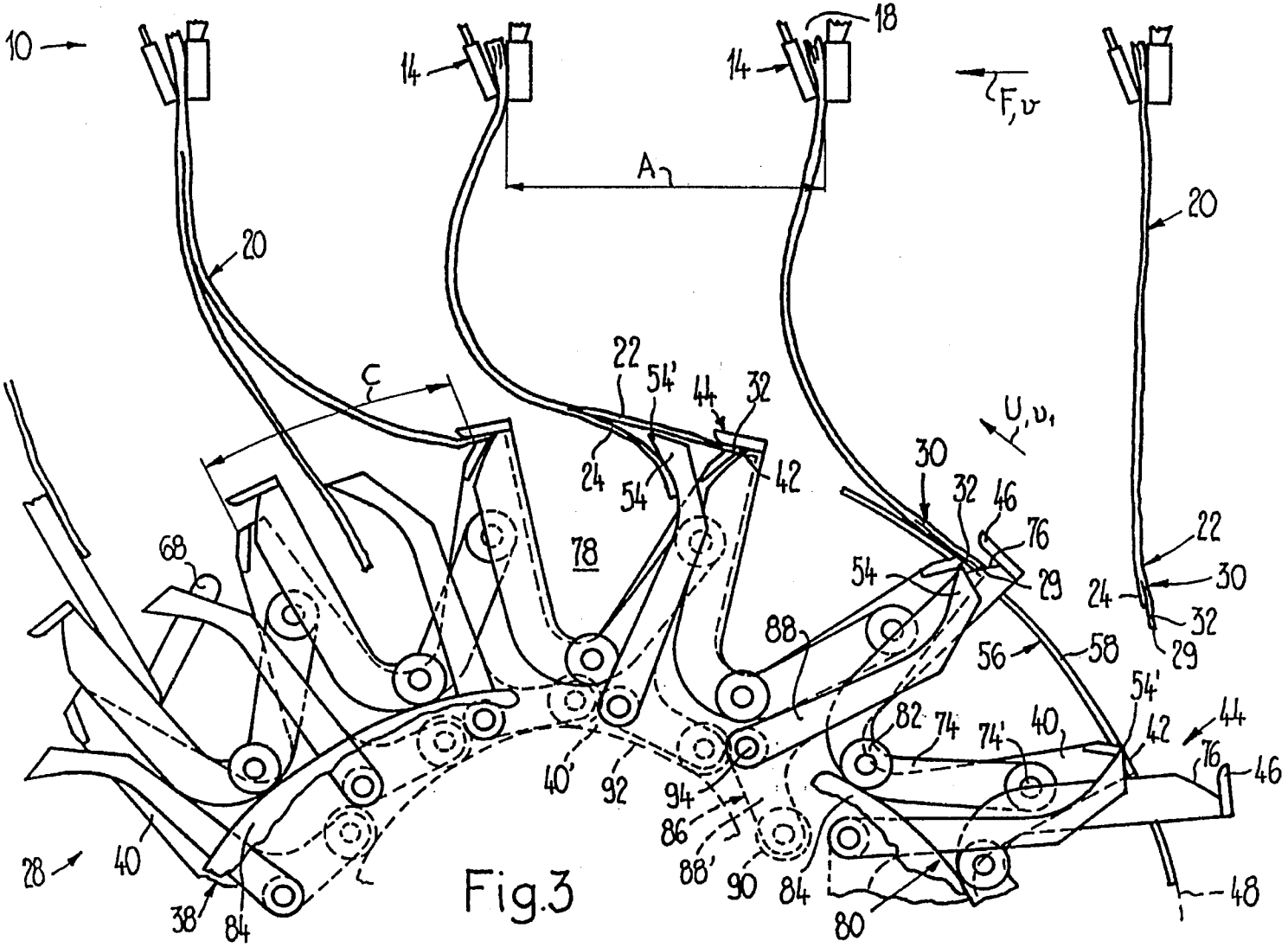
FIG. 3 shows (in elevation and enlarged in comparison with FIG. 1) part of a second embodiment of the apparatus according to the invention for opening printed products with a trailing first product part.

In the case of the opening unit 28 according to FIG. 3, a wheel-like carrying member 38 is also mounted in a rotationally fixed manner on the shaft 36 (cf. FIGS. 1 and 2). However, in comparison with the embodiment according to FIGS. 1 and 2, it is larger in diameter and correspondingly has a greater number of radially projecting carrying arms 40. The spacing C of the outer ends of the carrying arms 40 correspond approximately to or are less than the spacing A of the transport clips 14. The ends of the carrying arms 40 (tangential surfaces) are likewise designed as gripper jaws 42 of the grippers 44. These interact with gripper tongues 46, which are each arranged at one end of a control lever 74. The control lever 74 which is bent in the form of a substantially U-shaped member, such as a U or V, and is pivotally mounted at the other end of the carrying arm 40 trailing the respective gripper 44, (seen in circulating direction U). In the end region facing the gripper tongue 46, the control levers 74 have a stop surface 76, which is coaxial to the pivot axis 74' of said lever, parallel to the shaft 36, and over which the gripper jaw 42 extends. Against this stop surface 76 there comes to bear in each case the end edge 29 of the first product part 22. In the case of the embodiment shown in FIG. 3, the grippers 44 are directed forward (seen in circulating direction U) in order to seize the printed products 20. The printed products are supported by the supporting plates 58 of the supporting element 56 in their end region 30 and are bent rearward in conveying direction F, in the end section 32 of the upper-lying first product part 22, which end section projects with respect to the second product part 24. Between respectively neighboring carrying arms 40 there is a free space 78. The free space is outwardly open (seen in the radial direction) and reaches from the circulating path 48 of the grippers 44 to the control levers 74 which are bent inward (seen in the radial direction). The second product part 24 can escape into this free space 78 during opening of the printed products 20.

The grippers 44 are controlled by means of a link or cam motion 80. For this purpose, the control levers 74 have in the region of their bend a freely rotatably mounted control roller 82, which interacts with a fixed-in-place opening link or cam 84. The control levers 74 are prestressed in the direction of the closed position of the grippers 44 (in the counterclockwise sense in FIG. 3). The gripper tongues 64 are transferred by means of the opening link 84 counter to this prestress from the closed position into the open position.

A two-armed angle lever 86 is mounted in the region of the root 40' of each carrying arm 40. The two-armed angle lever is mounted freely pivotally on the carrying member and is prestressed by means of a spring (cf. FIG. 5) in the clockwise sense into a position of rest. The one, approximately radially running lever arm 88 is bent forward in circulating direction U in its outer end region and serves as a stabbing element 54 with a stabbing edge 54'. In the position of rest of the angle lever 86, the stabbing edge 54' is (seen in circulating direction U) in the region of the gripper jaw 42. In the radial direction the stabbing edge is equally far or slightly less far away from the axis of the shaft 36 (FIGS. 1 and 2) as the gripper jaw 42 (cf. in this respect in FIG. 3 the two grippers 44 located in the region of the supporting plates 58). The other lever arm 88', approximately at right angles to the lever arm 88, bears at its trailing end in a freely rotatable manner a follow-up roller 90. The follow-up roller 90 interacts with a stabbing link or cam 92. The stabbing cam 92 swivels the angle lever 86 in a clockwise manner. The stabbing element 54 is thereby accelerated with respect to the gripper 44 in a circulating direction U and moves away from the gripper in order to open the printed product 20. With regard to the more specific embodiment of the gripper tongues 46, control levers 74, link motion 80, angle lever 86 with associated opening link 84, further reference is made to FIG. 5 and the corresponding description below.

The opening unit 28 according to FIG. 3 functions as follows: the printed products 20, transported in vertical suspended position, with the first product part 22 trailing with respect to the shorter second product part 24, in conveying direction F at conveying speed v, come to bear with their end region 30 against the supporting plates 58. The end region 30 is thereby bent rearward and in this region the first product part 22 is then upper-lying (see FIG. 3, the second printed product 20 from the right). Due to the raising of the end region 30 of the respective printed product 20, the speed of this end region 30 is temporarily reduced. An opened gripper 44 then fetches this printed product 20, the end edge 29 of the first product part 22 coming to bear against the stop surface 76 (second gripper 44 from the right). The gripper 44 is then closed for seizing the end section 32, in that the gripper tongue 46 is transferred into the closed position by there being a reduction in the distance of the opening link or cam 84 from the axis of the shaft 36 (FIGS. 1 and 2). Finally, the control roller 82 runs off the opening link or cam 84, before the gripper 44 has reached the end of the supporting plate 58. It should also be mentioned that, due to the bending of the printed products 20 to the rear, the exposed region of the end section 32 is increased, thereby increasing the reliability that the second product part 24 is not also seized by the grippers 44.

As soon as a gripper 44 leaves the region of the supporting plates 58, the follow-up roller 90 of that assigned angle lever 86 runs onto the stabbing link 92. Whereupon the lever arm 88 with the stabbing elements 54 is swiveled forward in circulating the direction U about its bearing axis 94. As a result, the stabbing element 54 stabs from below between the two product parts 22, 24. As the stabbing element 54 moves away from the gripper 44, it lifts the second product part 24 downward off of the held first product part 22. The free end region of the second product part 24 then comes to lie in the free space 78. There then comes into engagement between the product parts 22, 24, lifted off each other, the end on that side of the opening elements 68, in order to open more fully and hold open the printed products 20 during further transport to the processing drum 70. After the engaging of the opening elements 68, the gripper 44 is again opened by the control rollers 82 running again onto the opening link 84. During stabbing, the path of movement of the stabbing edge 54' has the same distance from the shaft 36 as the gripper jaw 42.

Figure 4:
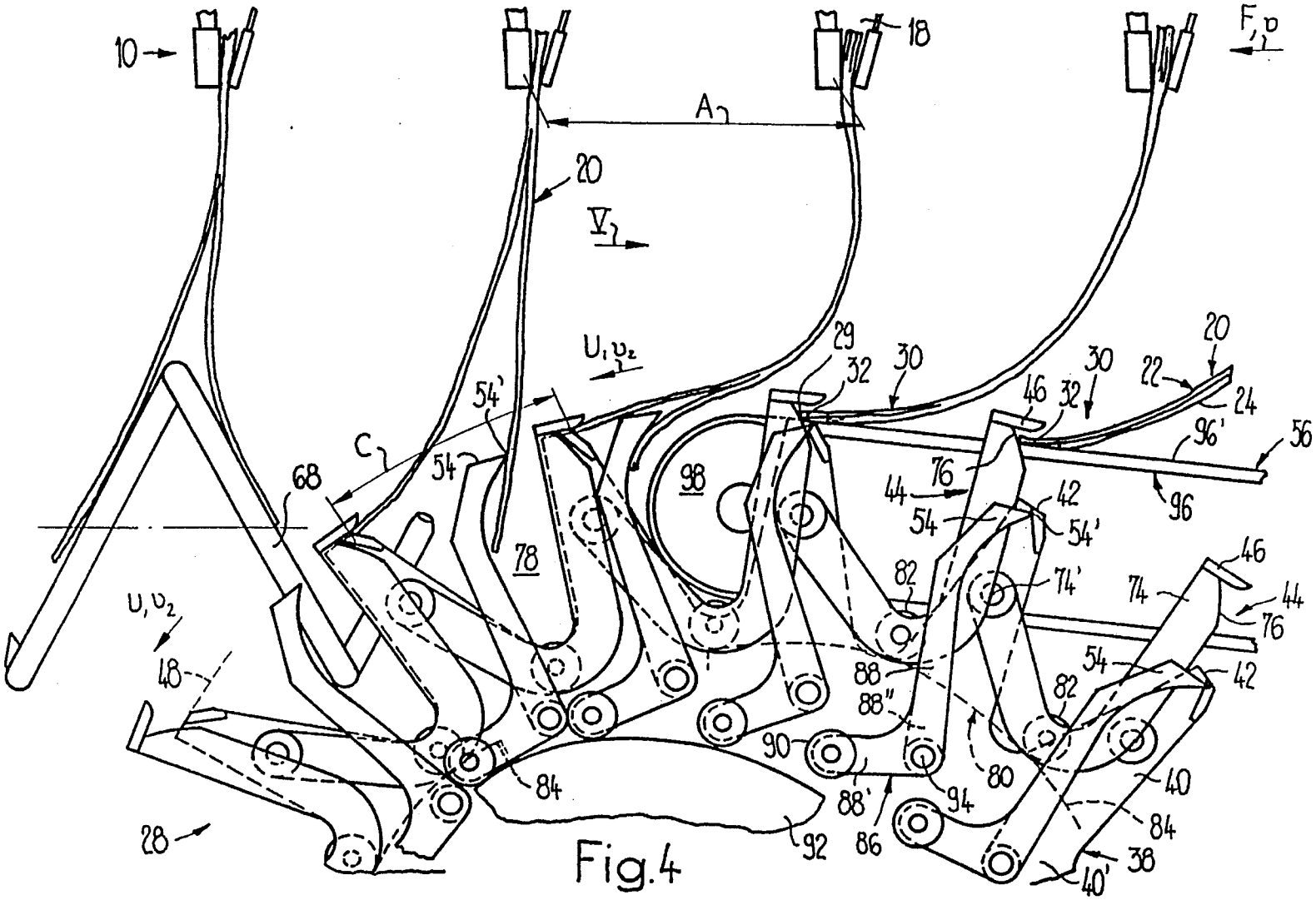
FIG. 4 shows, in the same representation as FIG. 3, a corresponding embodiment for opening printed products with a leading first product part.
Figure 5:
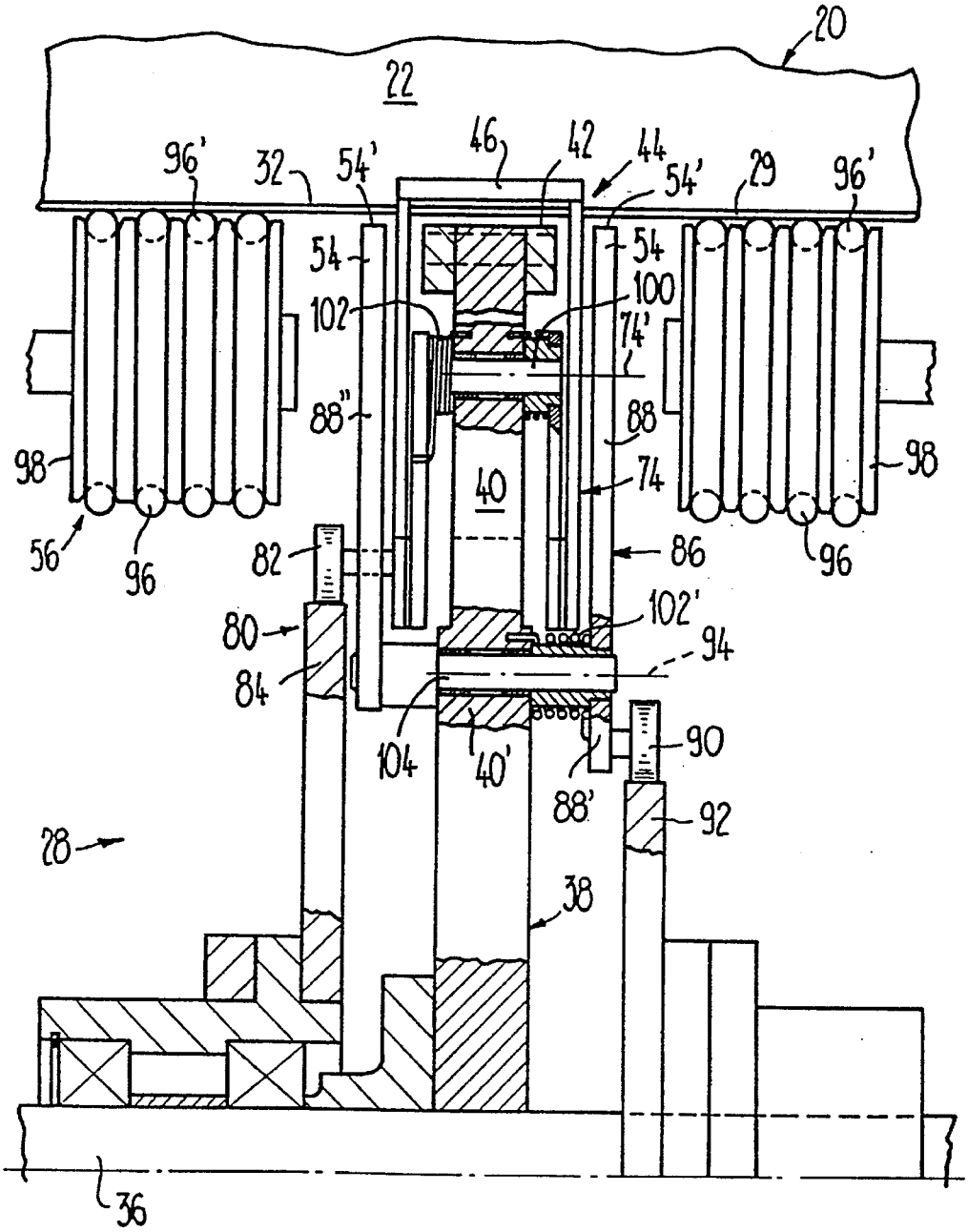
FIG. 5 shows the embodiment according to FIG. 4 in a section along the line V of FIG. 4.

In the embodiment shown in FIGS. 4 and 5, the carrying member 38 with the parts arranged thereon, such as grippers 44, control levers 74, angle levers 86 with stabbing elements 54, is designed substantially the same as the embodiment according to FIG. 3. The only difference is that this structural unit is now turned through 180° about a diametral axis in its arrangement on the shaft 36 (FIGS. 1 and 2), so that the grippers 44 are now directed to the rear (seen in the circulating direction U). The construction of this structural unit is therefore not described any further. Only the form of the opening link 84 and of the stabbing link 92 is different, to which reference will be made however in the functional description. It should also be mentioned that the spacing A of the transport clips 14 is equal to, but preferably slightly greater than, the spacing C between the grippers 44.

The supporting element 56 arranged ahead of the opening unit 28 has the embodiment of FIGS. 4 and 5 a plurality of supporting straps 96, which are led around deflecting rollers 98. Of these, only those are shown which are arranged and driven in the end region, facing the opening unit 28, of the supporting element 56. The vertical distance of the effectively supporting upper side 96' of the supporting straps 96 from the conveying device 10 decreases in conveying direction F. Thus, the printed products 20 which are transported in a vertical suspended position come to bear with their free end on the effectively supporting side 96', and the printed products 20 are always bent to a greater extent forward (seen in conveying the direction F) in their end region 30. This results from the supporting straps 96' being driven in such a way that the effectively supporting upper sides 96' move in the conveying direction F at approximately twice the conveying speed v.

The printed products 20 are conveyed with the first product part 22 leading with respect to the second, shorter product part 24. In this manner, due to the forward bending of the end region 30, the first product part 22 with the projecting end section 32 is then upper-lying with respect to the second product part 24. Due to the bending of the printed products 20, here too the end section 32 is again increased.

As FIG. 5 shows, each control lever 74 is formed by a pair of levers. One of these levers is arranged on each side of the carrying member 38 and these levers are firmly connected to each other by means of a bearing shaft 100, coaxial to the swivel axis 74'. The bearing shaft 100 passes through the carrying arm 40. Between the carrying arm 46 and the levers there is arranged in each case a spiral spring 102. The spiral spring embraces the bearing shaft 100 and prestresses the two levers of the control lever 74 in a direction counter to the closed position of the gripper tongues 46. The grippers tongues 46 connect the two levers of the pair of control levers to each other at the end remote form the bearing shaft 100. The control roller 82 is mounted on one of the two levers of the pair of levers and interacts with the opening link or cam 84. The opening link 84 is seated rotatably on the shaft 36, but is supported in a known rotationally locked and adjustable manner. For the sake of completeness, it should also be mentioned that the pairs of levers of the control levers 74 are cranked in the region of their bend, in order to be further spaced apart from each other in their leg region facing the gripper tongue 46. This is also done in order to embrace at a distance the levers mounted on the neighboring carrying arm 40 of the control lever 74.

The carrying member 38 is passed through in the region of the roots 40' of the carrying arms 40 in each case by a further bearing shaft 104. An angle lever 86 is in each case seated in a rotationally fixed manner on the further bearing shaft 104. Between the angle lever 86 and the carrying element 38, the further bearing shaft 104 is embraced by a further spiral spring 102' This further spiral spring 102' prestresses the angle lever 86 into its position of rest, as already described above in conjunction with FIG. 3. The lever arm 88 of the angle lever 86 is designed in its free end region as a stabbing element 54 with stabbing edge 54'. The other lever arm 88' bears the follow-up roller 90 freely rotatably, which interacts with the stabbing link 92. The stabbing link 92 is likewise seated freely rotatably on the shaft 36 and is likewise supported in a known rotationally locked and adjustable manner on the frame 34. On the side of the carrying member 38 facing away from the angle lever 86 there is likewise seated, in a rotationally secure manner on the further bearing shaft 104, a lever arm 88". The lever arm 88" corresponds to the lever arm 88 and runs parallel to the latter and is likewise designed in its free end region as a stabbing element 54. Consequently, on both sides of a gripper 44, a stabbing element 54 stabs between the first product part 22, held by the respective gripper 44, and the second product part 24.

The operating principle of the embodiment shown in FIGS. 4 and 5 is as follows. As soon as the gripper tongue 46 of an opened gripper 44 respectively comes into a position lying above the supporting straps 96 during rotation in circulating direction U, a printed product 20 runs with its end section 32 into the gripper mouth and comes to bear with its end edge 29 against the stop surface 76. This is because the circulating speed v2 of the grippers 44 is less than the conveying speed v of the conveying device 10. Moreover, the supporting straps 76 are arranged in a rising manner. Thus, the end region 30 is moved forward in the conveying direction F with respect to the corresponding transport clip 14. In the end region of the actively supporting side 96', the grippers 44 are closed, in that the distance of the opening link 84 from the axis of the shaft 36 is reduced and the link ultimately releases the control roller 82. Up until this time, the stabbing elements 54 have been swiveled into the rest position. As soon as a gripper 44 is closed, the follow-up roller 90 of the respective angle lever 86 then runs onto the stabbing link 92. The stabbing elements 54 are thereby swiveled in the clockwise sense, whereby their speed is reduced with respect to the circulating speed v2 of the grippers 44. The stabbing elements 54 stab with the stabbing edges 54' between the two product parts 22, 24. As the stabbing elements 54 are removed from the gripper 44, the lower-lying second product part 24 is lifted off the held first product part 22. As this happens, the second product part 24 again passes into the free space 78. Between the product parts 22, 24, lifted off each other in this manner, there then comes into engagement the end on this side of the holding-open elements 68. Then the respective gripper 44 is opened, since the control roller 82 again runs onto the opening link 84. The holding-open elements 68 hold the printed products 20 open during further transport.

Figure 6:
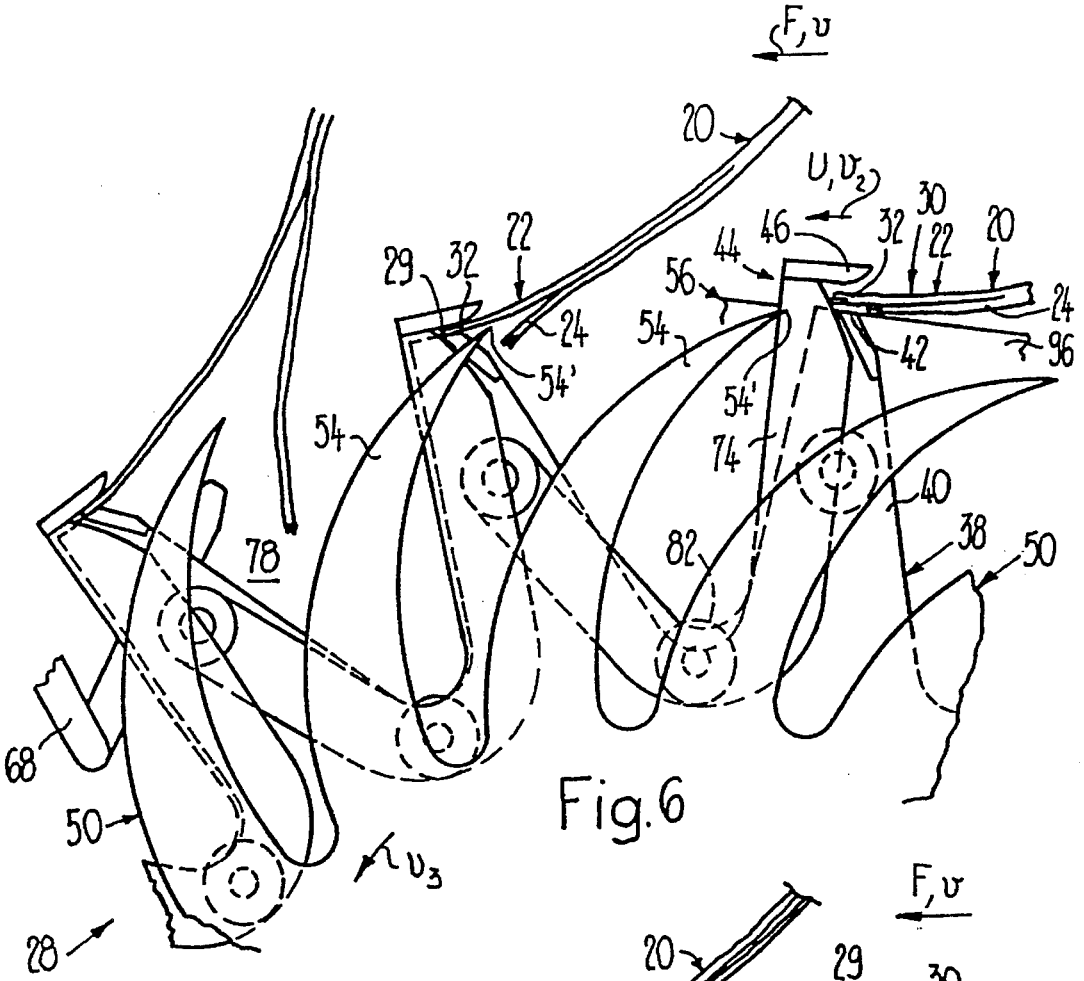
FIG. 6 shows (in elevation) part of a further embodiment of the apparatus according to the invention with stabbing elements arranged on a stabbing wheel.

The embodiment of the opening unit 28 shown in FIG. 6 corresponds to that according to FIGS. 4 and 5, although the stabbing elements 54 are not arranged on the angle levers 86 mounted on the carrying member 38. In a similar manner to that shown in FIGS. 1 and 2, there is mounted freely rotatably on the shaft 36 a stabbing wheel 50, on which the stabbing elements 54 are arranged in the manner of saw blade teeth. The number of stabbing elements 54 is greater than the number of grippers 44 and the stabbing wheel 50 is driven correspondingly at a proportionally lower circulating speed v3 than the circulating speed v2 of the grippers 44.

In exactly the same way as the embodiment according to FIGS. 4 and 5, the printed products 20 are transported in conveying direction F at the conveying speed v, the first product part 22 leading with respect to the second product part 24. The end region 30 of the printed products 20 is supported by means of supporting straps 96. Since the circulating speed of these supporting straps 96 is greater than the conveying speed v, the printed products 20 are bent forward in conveying direction F, so that the end section 32 is leading and the first product part 22 is upper-lying. Each first product part 22 runs into an opened gripper 44 and comes to bear with its end edge 29 against the stop surface 76. As soon as the respective closed gripper 44 has left the actively supporting region of the supporting straps 96, a supporting element 56 stabs with its stabbing edge 54' from underneath the end section 32 between the held first product part 22 and the underlying second product part 24. Since the circulating speed v3 of the stabbing wheel 50 is lower than the circulating speed v2 of the grippers 44, the respective stabbing element 54 distances itself to the rear from the gripper 44. The second product part 24 is thereby lifted off downward from the first product part 22. As already described above, the ends on this side of the holding-open elements 68 then engage between the product parts 22, 24, lifted off each other. After this, the gripper 44 is opened and the latter releases the first product part 22.

Figure 7:
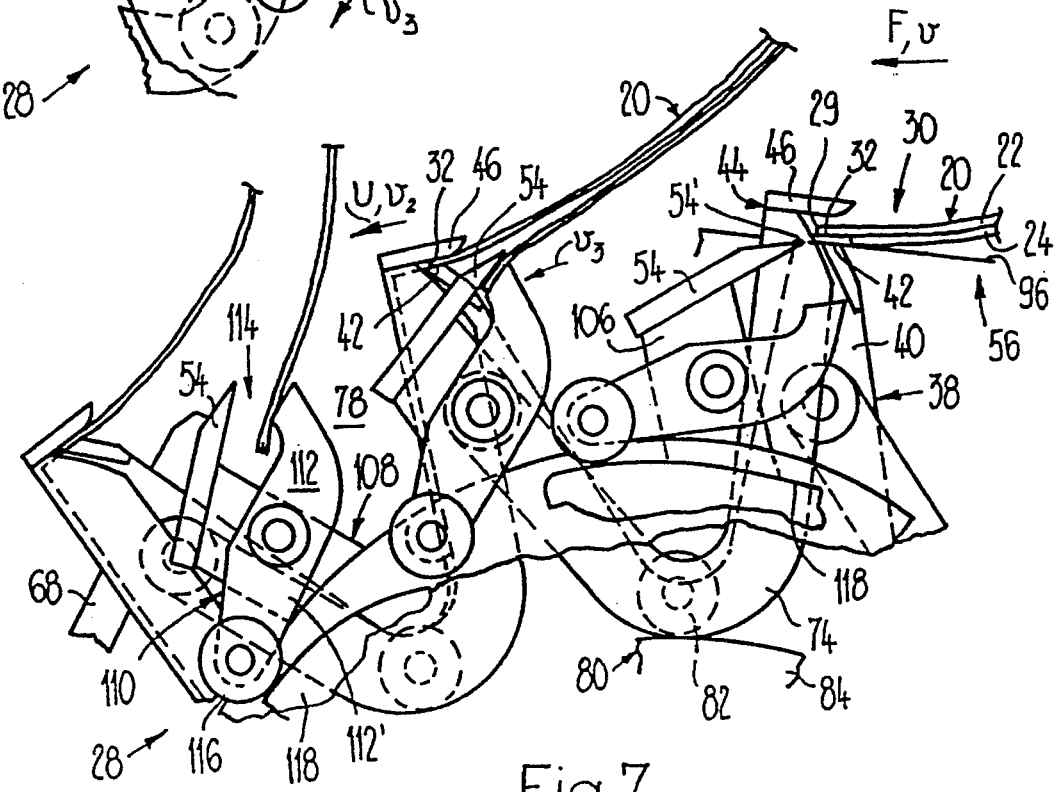
FIG. 7 shows, in the same representation as FIG. 6, a further embodiment with clamping levers assigned to the stabbing elements for temporarily holding firm the second product parts.

In the further embodiment shown in FIG. 7, the grippers 44 are designed and actuated in the same way as shown in the embodiments according to FIGS. 4 to 6. However, the stabbing elements 54 are now likewise arranged in the manner of a star-like stabbing wheel on the radially outer ends of bearing arms 106 of a bearing element 108. The number of stabbing elements 54 corresponds to the number of grippers 44, although the diameter of the circular path of movement of the stabbing elements 54 is smaller than the diameter of the circular circulating path 48 of the grippers 44. In a way corresponding to this diameter ratio, the bearing element 108 is driven at a proportionally lower rotational speed than the carrying member 38 carrying the grippers 44. The bearing element 108 is arranged eccentrically with respect to the axis of the shaft 36, on which the carrying member 38 is seated. The path of movement of the stabbing edges 54' forms a tangent to the circulating path 48 of the grippers 44 from the inside at the point where the stabbing elements 54 stab into the respective products 20, i.e. in the upper region of the circulating path 48, at the end of the supporting element 56.

On each bearing arm 106 there is pivotally mounted a two-armed clamping lever 110. The trailing lever arm 112 of the two-armed clamping lever 110 (seen in circulating direction U) forms together with the stabbing element 54 a clip 114, in order to firmly clamp the second product part 24 temporarily after stabbing. The clamping lever 110 is prestressed in the direction of its clamping position. The clamping lever 110 has, on its leading lever arm 112', a freely rotatably mounted control wheel 116, which interacts with a control link 118 in order to open the clip 114.

The printed products 20 are conveyed in exactly the same manner as shown in FIGS. 4 to 6. That is, the printed products 20 are conveyed with the first product part 22 leading with respect to the second product part 24 and supported in the end region 30 by means of supporting straps 96, so that the printed products 20 are bent forward (seen in conveying direction F) and the first product part 22, having the projecting end section 32, is again upper-lying. In the region where the printed products 20 are introduced with their end section 32 into the opened grippers 44, the clips 114 are open due to the action of the control link 118 (as shown on the extreme right in FIG. 7 by the clip 114). The corresponding gripper 44 now seizes the end section 32 and holds it firmly. The gripper 44 then distances itself from the region of the supporting straps 96, the stabbing element 54 stabs between the product parts 22 and 24 on account of its lower circulating speed v3 with respect to the circulating speed v2 of the grippers 44. Then, the control wheel 116 runs off the fixed-in-place control link or cam 118 and the clip 114 closes. As a result, the second product part 24 is clamped in and held between the stabbing element 54 and clamping lever 110. Again on account of the different speeds v2, v3 between the grippers 44 and the clips 114 and on account of the smaller diameter of the path of movement of the clips 114, the second product part 24 is now lifted off downward from the first product part 22. Subsequently, the clip 114 is opened again by means of the control link 118 (see clip 114 on the left). After this, the opening element 68 engages between the product parts 22, 24 in the manner described above, in order to hold the product parts away from each other during further transport. It will be recognized that here too the grippers 44 are opened as soon as the holding-open elements 68 engage between the product parts 22, 24.

Figure 8:
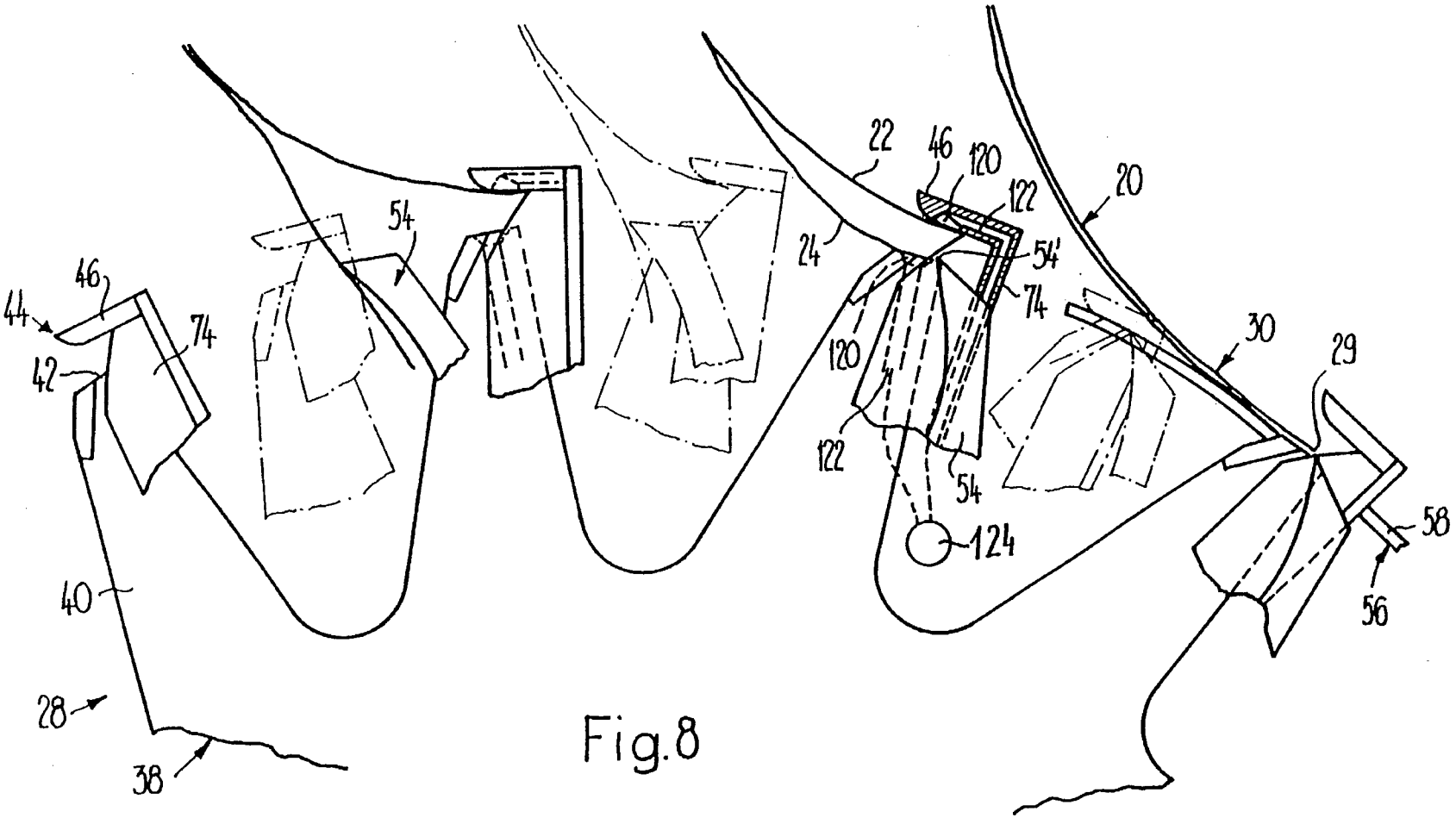
FIG. 8 shows in elevation part of a further embodiment, similar to the embodiment according to FIG. 3, of the apparatus according to the invention for opening two-fold printed products and printed products in which each product part is of a single-sheet design.

In the case of the embodiment shown in FIG. 8, the design of the carrying member 38, of the grippers 44 and of the angle levers 86, mounted on the carrying member 38 with the stabbing elements 54, corresponds to the embodiment shown in FIG. 3. The only difference is that the gripper jaws 42 and gripper tongues 46 have on the actively clamping sides openings 120 which can be connected via channels 122 in the carrying arms 40 and control levers 74 to a vacuum source 124. This embodiment is suitable for the opening of centrally folded printed products 20 and two-fold printed products. Such two-fold printed products are first folded once and then folded a second time at right angles thereto and are transported while held at this second fold by the transport clips 14.

The printed products 20, transported in a vertical suspended position, running with their free end region 20 onto the supporting plates 58, are supported and bent rearward (seen in the conveying direction F). A gripper 44 picks up the printed product 20, which is then seized at its end edge 29 by closing of the gripper 44 and is held. The channels 122 are then connected to the vacuum source. Once the gripper 44 has left the region of the supporting plates 58, the gripper tongue 46 is transferred into the open position. Since, however, there is now a vacuum in the openings 120, the two product parts 22, 24 are firmly held and lifted off each other at the gripper tongue 46 or gripper jaw 42. The opening in the gripper jaw 42 is now separated from the vacuum source, whereupon the jaw releases the second product part 24. At the same time, the angle lever 86 is swiveled in the counterclockwise direction, so that it stabs with its stabbing element 54 between the product parts 22, 24, which are already lifted a little off of each other. By the further movement of the stabbing element 54, the second product part 24 is pushed off the upper jaw 42 and the printed product 20 is further opened. As soon as the holding-open element 68 has engaged between the two product parts 22, 24, lifted off each other, the opening 120 in the gripper tongue 46 is also separated from the vacuum source. The first product part 22, held up until then, is thereby also released. If two-fold printed products 20 are to be opened, the opening unit 28 is preferably arranged laterally offset with respect to the conveying device 10. In this manner it acts on the printed product 20 at the lateral fold. It will be recognized that it is also conceivable to open printed products 20 with leading end region 30. In this case, the carrying member 38 with the grippers 44 and the supporting elements 56 is again to be turned through 180° about a diametral axis on the shaft 36 (FIGS. 1, 2).

In all of the embodiments shown, the circulating path 48 of the grippers 44 has an actively holding region in which the grippers 44 are closed, in order firmly to hold the first product part 22. Alternatively, in the embodiment according to FIG. 8, the grippers 44 may be closed or the grippers 44 may be opened when the openings 120 in the gripper tongues 46 are connected to the vacuum source, in order firmly to hold the first product part 22. Also in all of the embodiments, a section of the closed path of movement of the stabbing elements 54 runs at the actively holding region of the circulating path of the grippers 44, in order to stab into the printed products 20 in this region and in each case lift the second product part 24 off the first product part 22. In this case, the path of movement of the stabbing elements 54 in each case forms a tangent to the circulating path 48, as shown in the examples. However, it would also be conceivable in the case of the embodiments according to FIGS. 3 to 5 and 8 to mount the pivot axes of the stabbing elements 54 outside a straight line between the grippers 44 and the shaft 36. In this manner the stabbing edge 54' intersects the circulating path 48 during stabbing.

It would also be conceivable to arrange the grippers 44 and stabbing elements 54 on an endless drawing member, so that the circulating path of the grippers 44 runs in a straight line in certain regions. The holding-open elements 68 could be designed to be hollow on the inside and be connected to a pressure source or vacuum source 126, see FIG. 1. The medium (preferably air) fed via the holding-open elements 68 acts via outlet openings (holes, slits and the like 128) in the wall of the holding-open elements 68 on the product parts 22, 24, in order either to spread (in the case of pressure) or suck (in the case of vacuum) the product parts further from each other.

It is to be understood that a wide range of changes and modifications to the embodiments described above will be apparent to those skilled in the art, and are also contemplated. It is therefore intended that the forgoing detailed description be regarded as illustrative rather than limiting, and that it be understood that it is the following claims including all equivalents which are intended to define the spirit and scope of this invention.

I claim:

1. An apparatus for opening folded printed products having a first product part and a second product part joined at a fold, each of said product parts having a free end edge opposite the fold, the apparatus comprising:

a conveying device including a plurality of transport clips, the transport clips being driven in a conveying direction and each clip adapted to hold a printed product at the fold and extending transversely to the conveying direction;

a supporting element arranged underneath the conveying device for supporting the printed products in the region of their free ends as the products are conveyed; and an opening unit adjacent the supporting element including a plurality of grippers driven in a circulating manner and each gripper adapted to seize the free edge of one of said product parts in each product;

said opening unit also including a stabbing element moveable relative to the grippers and effective to move between the product parts in each product and at least partially move the other part away from the one part whereby the printed product is opened.

2. The apparatus of claim 1 wherein:

said opening unit also includes a product holding-open element;

said holding-open element having a spiral configuration and adapted to rotate about a longitudinal axis extending generally in the conveying direction;

rotation of said spiral element being effective to hold open each opened printed product after its release by a gripper and before its release by a clip.

3. A process for opening folded printed products wherein the fold joins a first product part to a second product part, the method comprising the steps of:

holding suspended the printed products at their fold, the fold running transversely to a conveying direction and supported at their end region lying opposite the fold;

conveying the printed products in the conveying direction;

seizing the first product part and temporarily holding it at its end edge, lying opposite the fold, with a gripper;

driving the gripper approximately in the direction of movement of the end edge;

moving the other, second product part away from the held first product part;

stabbing the printed product between the held first product part and the second product part with a stabbing element, movable relative to the gripper;

moving the stabbing element and gripper away from each other such that while the stabbing element is moving away from the gripper, the second product part is at least partially lifted off of the first product part, whereby the printed product is opened.

4. The process as claimed in claim 3 wherein the printed products are folded off-center wherein:

the holding step comprises holding the off-center printed product in an approximately vertical suspended position and supporting the printed products in their end region such that, in the end region, the end section of the first product part projects beyond the second product part and is upper-lying; and wherein the first product part is seized and held at the end section by the gripper and the printed products are stabbed from underneath the end section by the stabbing element.

5. The process as claimed in claim 3 comprising:

arranging a spiral-like holding-open element such that its longitudinal axis runs in the conveying direction;

rotatably driving the spiral-like holding-open element about its longitudinal axis; and engaging the spiral-like holding-open element between the product parts, lifted at least partially off each other, to hold the printed products open after release of the first product part by the grippers.

6. An apparatus for opening folded printed products having a first product part and a second product part, the apparatus comprising:

a conveying device including transport clips, the transport clips being driven in a conveying direction and hold the printed products suspended at their fold, running transversely to the conveying direction and joining two product parts to each other;

a supporting element, arranged underneath the conveying device, the supporting element supporting the printed products at their end region lying opposite the fold; and an opening unit, arranged underneath the conveying device, the opening unit including:

1) a plurality of controllable grippers, driven in a circulating manner along a closed circulating path which runs by the supporting element, the grippers seizing the one, first product part at its end edge, lying opposite the fold;

2) an actively holding region subsequent to where the printed products are seized, including means for actuating the grippers to temporary hold the first product part, and means for moving the other, second product part away from the held first product part; and 3) a stabbing element, which is movable relative to the grippers, the stabbing element stabbing into the printed products between the held first product part and the second product part within the actively holding region of the circulating path of the grippers wherein, during the moving away of gripper and stabbing element from each other, the stabbing element lifts the second product part at least partially off of the first product part, whereby the printed product is opened.

7. The apparatus as claimed in claim 6 wherein:

the grippers are arranged on a carrying member, which is driven in a rotating manner;

the opening unit includes a plurality of stabbing elements, driven in a circulating manner along a closed path of movement, a section of the path of movement running by the actively holding region of the circulating path of the grippers; and the speed of the stabbing elements in the section is variable relative to the circulating speed of the grippers.

8. The apparatus as claimed in claim 6 wherein:

the grippers are arranged on a carrying member, which is driven in a rotating manner;

the opening unit includes a plurality of stabbing elements, driven in a circulating manner along a closed path of movement, a section of the path of movement running by the actively holding region of the circulating path of the grippers; and the speed of the stabbing elements in the section is different relative to the circulating speed of the grippers.

9. The apparatus as claimed in claim 8 wherein between respectively neighboring grippers, there is between the circulating path of the grippers and the carrying member a free space, into which the second product part can engage during opening of the printed products.

10. The apparatus as claimed in claim 9 wherein the carrying member comprises a star-like member including radially projecting carrying arms with radial end regions, and wherein the grippers are disposed on the radial end regions.

11. The apparatus as claimed in claim 10 wherein each of the grippers comprises a fixedly arranged gripper jaw and a movable gripper tongue which interact with each other and wherein the fixedly arranged gripper jaw is arranged on the radially outer end of the carrying arm.

12. The apparatus as claimed in claim 11 comprising a plurality of pivotally mounted substantially U-shaped control levers, each of the control levers disposed on one of the carrying arms and bearing a gripper tongue, which interacts with a gripper jaw, the gripper jaw being fixedly arranged on a neighboring carrying arm.

13. The apparatus as claimed in claim 12 wherein the control levers are prestressed in the direction counter to the closed position of the grippers and comprising a link to swivel the control levers in the opposite direction in order to open the grippers.

14. The apparatus as claimed in claim 8 wherein each gripper is assigned a stabbing element, which is mounted on the carrying member and the path of movement of which, seen in the radial direction, forms a tangent to the circulating path, for stabbing in the actively holding region of the circulating path of the grippers.

15. The apparatus as claimed in claim 8 wherein each gripper is assigned a stabbing element, which is mounted on the carrying member and the path of movement of which, seen in the radial direction, intersects the circulating path, for stabbing in the actively holding region of the circulating path of the grippers.

16. The apparatus as claimed in claim 8 comprising a rotatingly driven stabbing wheel, with stabbing elements arranged as projecting radially, the circumferential speed of the stabbing wheel being different from the speed of the grippers.

17. The apparatus as claimed in claim 8 comprising:

a pivotally mounted bearing element having radially projecting bearing arms, the stabbing elements being arranged on the radially projecting bearing arms; and controlled clamping levers arranged on the bearing arms, the controlled clamping levers interacting with the stabbing elements, in order firmly to clamp the second product part temporarily after the stabbing into a printed product.

18. The apparatus as claimed in claim 6 comprising a vacuum source and wherein the gripper jaws and gripper tongues have openings, for connection to the vacuum source, in order to hold the two product parts during opening of the grippers and lift them off each other at the border lying opposite the fold, and wherein the stabbing elements stab between the product parts thereby lifted off each other.

19. The apparatus as claimed in claim 6 wherein:

the printed products are folded off-center such that they have on their first product part an end section projecting beyond the second product part;

the transport clips transport the off-center folded printed products in an approximately vertical suspended position and with the first product part trailing with respect to the second product part;

the supporting element includes a fixed supporting member, in order to support the printed products with, seen in the conveying direction, rearwardly bent end region and upper-lying end section;

the mouths of the grippers are, seen in circulating direction, directed forward; and the stabbing elements move at a greater speed than the grippers.

20. The apparatus as claimed in claim 6 wherein:

the printed products are folded off-center such that they have on their first product part an end section projecting beyond the second product part;

the transport clips transport the off-center folded printed products in an approximately vertical suspended position and with the first product part leading with respect to the second product part;

the supporting element includes a supporting belt, the supporting belt driven in a circulating manner at a greater speed relative to the transport clips, in order to support the printed products with, seen in the conveying direction, forwardly bent end region and upper-lying end section;

the mouths of the grippers are, seen in circulating direction directed rearward; and the stabbing elements move at lower speed than the grippers.

21. The apparatus as claimed in claim 6 wherein the opening unit comprises a spiral-like holding-open element, the spiral-like holding-open element driven rotatingly about its longitudinal axis, running in the conveying direction, and the spiral-like holding-open element engaging with its rear end, seen in the conveying direction, in each case between the product parts which have been lifted off of each other, in order to hold the opened printed products open after release of the first product part by the grippers during further transport.

22. The apparatus as claimed in claim 21 comprising a processing drum following the opening unit, the processing drum having saddle-shaped rests, onto which the opened printed products are deposited astride by opening of the transport clips, the rests engaging from below between the turns of the holding-open element and the product parts, lifted off each other.

23. The apparatus as claimed in claim 21 wherein the pitch of the turns of the holding-open element increases from its rear end toward its front end.

24. The apparatus as claimed in claim 21 wherein the holding-open element is fastened displaceably in the direction of its longitudinal axis on an input shaft.

25. The apparatus as claimed in claim 21 comprising a vacuum source and wherein the holding-open element includes a feed, connected to the vacuum source, in order to suck the product parts to the feed.

26. The apparatus as claimed in claim 21 comprising a pressure source and wherein the holding-open element includes a feed, connected to the pressure source, in order to direct compressed air against the product parts.

* * * * *